United States Patent [19]

Slater

[11] 4,228,416

[45] Oct. 14, 1980

[54] COMPOSITE MAGNET AND MAGNETIC ANCHORING

[75] Inventor: Saul I. Slater, Miami Beach, Fla.

[73] Assignee: Hov-Air-Ship, Inc., Miami Beach, Fla.

[21] Appl. No.: 942,706

[22] Filed: Sep. 15, 1978

[51] Int. Cl.[2] ..... H01F 7/04; H01F 7/02

[52] U.S. Cl. ..... 335/295; 335/302; 335/306

[58] Field of Search ..... 335/285, 291, 293, 295, 335/296, 297, 301, 302, 306

[56] References Cited

U.S. PATENT DOCUMENTS

| | | | |
|---|---|---|---|
| 2,268,011 | 12/1941 | Beechlyn | 335/295 |
| 3,059,156 | 10/1962 | Moriya | 335/306 X |
| 3,169,184 | 2/1965 | Vye | 335/285 X |
| 3,432,941 | 3/1969 | Minchom | 335/306 X |
| 3,452,310 | 6/1969 | Israelson | 335/295 X |
| 3,755,706 | 8/1973 | Scott | 335/296 X |
| 4,025,911 | 5/1977 | Bobeck et al. | 335/306 X |
| 4,114,532 | 9/1978 | Arzoumanian | 335/306 X |

FOREIGN PATENT DOCUMENTS

| | | | |
|---|---|---|---|
| 775540 | 5/1957 | United Kingdom | 335/295 |

*Primary Examiner*—Fred L. Braun

*Attorney, Agent, or Firm*—Morgan, Finnegan, Pine, Foley & Lee

[57] ABSTRACT

A composite magnet includes at least two magnet members oriented to have their polar axes parallel and aligned, with corresponding poles facing the same direction, and two pole members made of magnetically attractive material abutting the polar surfaces of the magnets, each one abutting all the poles of a particular polarity so that one pole member forms a composite North pole and the other forms a composite South pole. A permanent magnet anchoring assembly includes a casing, made of a non-magnetically attractive material, encasing a permanent magnet member to expose at least one surface thereof. The casing is formed with at least one bearing edge located adjacent and extending parallel to and in the same plane as the exposed surface and a leverage arm extends generally perpendicular to the bearing edge for rotating the anchoring assembly about the bearing edge. As preferably embodied, the magnet member is adapted to provide both a North and a South pole at said exposed surface, and, advantageously, is the foregoing composite magnet. Also as preferably embodied, the bearing edge of the casing is beveled to facilitate rotation about the edge.

11 Claims, 4 Drawing Figures

COMPOSITE MAGNET AND MAGNETIC ANCHORING

BACKGROUND AND OBJECTS OF THE INVENTION

The present invention relates generally to magnets and more particularly to an improved composite magnet as well as a magnet anchoring assembly.

In the prior art, it is known that "bar" magnets can be combined to provide a composite magnet having greater magnetic attraction than each individual magnet, by coupling them together with pole pieces which are made of magnetically attractive material and placed in contact with the poles of the magnets. The magnets are positioned with their polar axes parallel but with the poles of adjacent magnets reversed relative to each other so that each pole piece abuts the North pole of one magnet and the South pole of an adjacent magnet because the magnets will be attracted to each other and remain in place. Although the resultant composite magnet may provide greater magnetic attraction than each individual magnet, it does not provide a composite magnet which is believed to utilize all the potential magnetic attraction inherent in the individual magnets.

Although electromagnets can provide strong magnetic attraction and can be quickly de-energized to permit eacy decoupling when desired, they tend to be heavy and, of course, they require a source of electrical power, militating against their use in many applications such as, for example, in anchoring aircraft to a ship's deck since the weight of such devices cannot be tolerated in aircraft. Moreover, in other applications where a powerful magnet could prove advantageous (e.g. for temporarily attaching a scaffold-like structure or some equipment to the hull of a ship to facilitate repairs or maintenance), an electromagnet may be completely impractical, particularly for work to be done under the water. Therefore, a composite permanent magnet adapted to provide substantially strong magnetic attraction is desirable.

However, although composite permanent magnets could offer certain advantages over electromagnets (e.g., lighter weight), they cannot be utilized because there is no known device or method enabling easy decoupling of the magnet from the structure to which it may be attached. The very strength of the magnet, which makes the composite permanent magnet desirable, precludes its being used since it is extremely difficult and impractical to break the resultant magnetic coupling with the deck. Either a crew of men or some heavy apparatus will be needed to disengage the magnet, thus defeating some of the advantages of using a permanent magnet, particularly in the case of the improved composite magnet according to the present invention.

Accordingly, it is an object of the present invention to provide a new and improved composite magnet. Another object of the present invention is to provide a new and improved anchoring assembly capable of utilizing a powerful permanent magnet.

It is also an object of the present invention to provide a new and improved composite magnet which is substantially more powerful than the sum of the magnetic attractions provided by its component magnet elements.

It is yet another object of the present invention to provide a new and improved permanent magnet anchoring assembly which enables a composite permanent magnet member to be used for providing powerful magnetic coupling capability yet enables relatively easy decoupling when desired.

It is still a further object of the present invention to provide a new and improved permanent magnet anchoring assembly which may be used for temporarily anchoring aircraft to the deck of a ship.

It is an additional object of the present invention to provide a new and improved permanent magnet anchoring assembly which permits temporary magnetic coupling to a structure made of a magnetically attractive material and easy removal and/or relocation of the anchoring assembly.

It is another object of the present invention to provide an assembly which enables the practical use of a samarium cobalt magnet, or any other powerful but "brittle" permanent magnet, without the normally attendant risk of shattering when the magnet is dropped or when it suddenly contacts a magnetically attractive substance.

Objects and advantages of the invention are set forth in part herein and in part will become apparent herefrom, or may be appreciated by practice with the invention, the same being realized and attained by means of the instrumentalities, combinations and methods pointed out in the appended claims. Accordingly, the present invention resides in the novel parts, constructions, arrangements, improvements, methods and steps herein shown and described.

SUMMARY OF THE INVENTION

Briefly described, the composite magnet assembly according to the present invention includes at least two magnet members positioned to have their polar axes essentially parallel and corresponding poles aligned, with two pole members made of magnetically attractive material abutting all the polar surfaces of the magnet members, each pole member abutting all polar surfaces of one particular polarity so that one pole member will form a composite North pole and the other will form a composite South pole, both composite poles being accessible in at least one common plane. As preferably embodied, the magnets are permanent bar magnets made of samarium cobalt and oriented with their polar axes perpendicular to the pole members. Thus, a method of forming a composite magnet according to the invention includes the steps of positioning at least two magnet members so that all the corresponding poles of the magnet members will align, and covering all the corresponding poles of the magnet members with a pole member made of magnetically attractive material.

According to another aspect of the present invention, a magnetic anchoring assembly includes permanent magnet means adapted to provide relatively strong magnetic attraction, with bearing edge means formed adjacent the magnetically attractive engaging surface and leverage means adapted to permit rotation of the permanent magnet means about the bearing edge means. Advantageously, the magnet means is a composite magnet having pole members, at least one of which provides the bearing edge means. As preferably embodied, the anchoring assembly includes a casing made of a non-magnetically attractive material, adapted to encase the magnet means and expose the engaging surface thereof. At least one portion of the casing is adapted to provide the bearing edge and the leverage means comprise an arm member attached to the casing and extending perpendicular to a bearing edge.

As further preferably embodied, the magnet member is the aforesaid composite magnet assembly and the portion of the casing adjacent the edge of at least one pole member is beveled so that the bearing edge means are formed at the juncture of the apex of the beveled edge and the pole member.

It will be apparent from the foregoing general description, as well as the following detailed description, that the objects and advantages of the invention specifically enumerated herein are accomplished by the invention as herein disclosed.

Thus, it will be found that by forming a composite magnet assembly by abutting all the North poles of the magnet members to one pole member and all the South poles to the other pole member, the composite magnet will provide much greater magnetic attraction than the sum of the attractions provided by all the individual magnets.

It will also be found that by forming a magnetic anchoring assembly with a bearing edge and a lever-arm, the anchoring assembly can be "rocked" or rotated about the bearing edge to permit relatively easy decoupling of the magnetically attractive engagement between the magnet means and any magnetically attractive structure.

It will further be found that by providing a magnetic anchoring assembly with a casing surrounding the magnet and having a beveled edge which provides the bearing edge for the anchoring assembly, powerful permanent magnets, such as samarium cobalt magnets which are relatively brittle, can be utilized therein without damaging the magnet.

In addition, it will be found that by utilizing the herein-disclosed composite magnet assembly in the magnetic anchoring assembly according to the present invention, it will be found that a substantially powerful magnetic anchor will be provided, which can be relatively easily de-coupled.

It will be understood that the foregoing general description as well as the following detailed description are exemplary and explanatory of the invention but are not intended to be restrictive thereof. Accordingly, the accompanying drawings, referred to herein and constituting a part hereof, illustrate preferred embodiments of the invention, and, together with the detailed description thereof, serve to explain the principles of the invention.

DETAILED DESCRIPTION OF PREFERRED EMBODIMENTS

Figure 1:
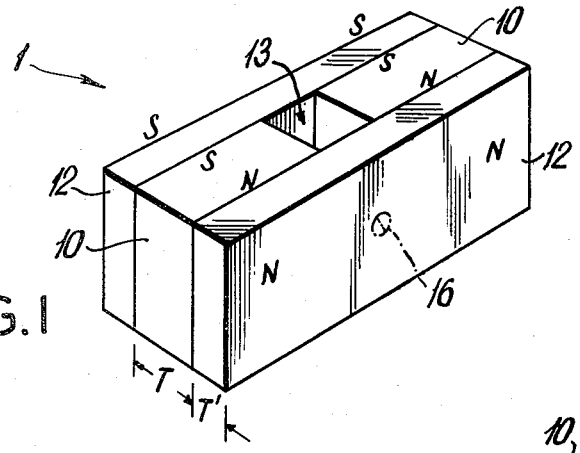
FIG. 1 is a perspective view of an embodiment of a composite magnet assembly according to the present invention.

Referring generally to the embodiments of the various aspects of the invention, illustrated in the accompanying drawings wherein like reference numerals refer to like parts throughout the various views, there is shown in FIGS. 1 and 2–4, embodiments of a magnet assembly and a magnetic anchoring assembly, respectively, according to the present invention.

Turning specifically to FIG. 1, the composite magnet assembly (indicated generally at 1) according to the present invention includes at least two magnets (each indicated at 10) which are oriented with their polar axes parallel and oriented with their poles in the same orientation (i.e., with all North poles pointing in the same direction). Two pole members (each indicated at 12) are positioned so as to cover the polar surfaces of all the magnets 10. Thus, each pole member 12 becomes a composite magnetic pole, i.e., either a composite North pole or a composite South pole. As preferably embodied, each pole member covers the entire surface of each corresponding pole of all magnets 10.

In assembling the structure illustrated in FIG. 1, it will be found that the magnet 10 must be forced into position and bonded in place since the aligned polar orientation of the magnets tends to repel each other with a repelling force equal to about twice the magnetic attraction provided by an individual magnet. However, the resultant composite magnet has been found to provide much greater magnetic attraction (almost 5 times greater) than a composite magnet structure with magnets having their polar axes parallel but their poles reversed relative to each other (as is done in the prior art). It can be theorized that by the configuration according to the present invention the lines of magnetic flux are somehow forced into a more favorable arrangement through the pole members, which results in a much greater magnetic attraction over conventional composite magnet members.

As preferably embodied, the dimensions of the pole members (which may be made of iron, Mu-metal, or any other magnetically attractive material) should be proportioned so as to carry all or nearly all of the magnetic flux while not being too massive or heavy. It has been found that for the block-like bar magnets (10) shown in the drawings, having a thickness T, the thickness (T') of each pole member 12 is about half or slightly greater than half of T so that the combined thickness of both plates 12 is preferably equal to or slightly greater than T.

For example, for a pair of magnets 10 made of samarium cobalt, wherein T equals about 7/16" for each and the dimensions perpendicular to the polar axes is about 1"×1", T' for each pole member 12 is about ¼" and about 2¼"×1" in its other dimensions, there being a gap (indicated at 13) between adjacent magnets 10. In such a prototype composite magnet, the resultant magnetic attraction has been found to be about 250 lbs. as opposed to about 56 lbs. provided by one such magnet alone and, curiously, also by a composite arrangement of two magnets with their polar axes parallel but their poles reversed relative to each other as in the prior art.

In order to construct composite magnet 1, the two magnets (10) are forcibly held in place between the two pole members 12 and a very thin layer of suitable adhesive (e.g. epoxy) is applied to each polar surface and the surface portions of the pole members, which abut the poles. In addition, the gap (13) between the two magnets may be filled with the same adhesive for ensuring a firm bond and one or more fasteners (indicated in phantom at 16 in FIG. 1 and preferably made of a non-magnetically attractive material so as not to short circuit any magnetic flux), such as a nut-and-bolt or a screw, may be threaded between the pole members through gap 13 to form a vice-like grip on the magnets for retaining the composite magnet together. It will be found that since the pole members of composite magnet assembly 1 make the actual physical contact during magnetic coupling with the desired structure, the magnet elements will be protected from any damage that might result from dropping or from "striking" contact at the moment of initial magnetically attractive coupling.

Figure 2:
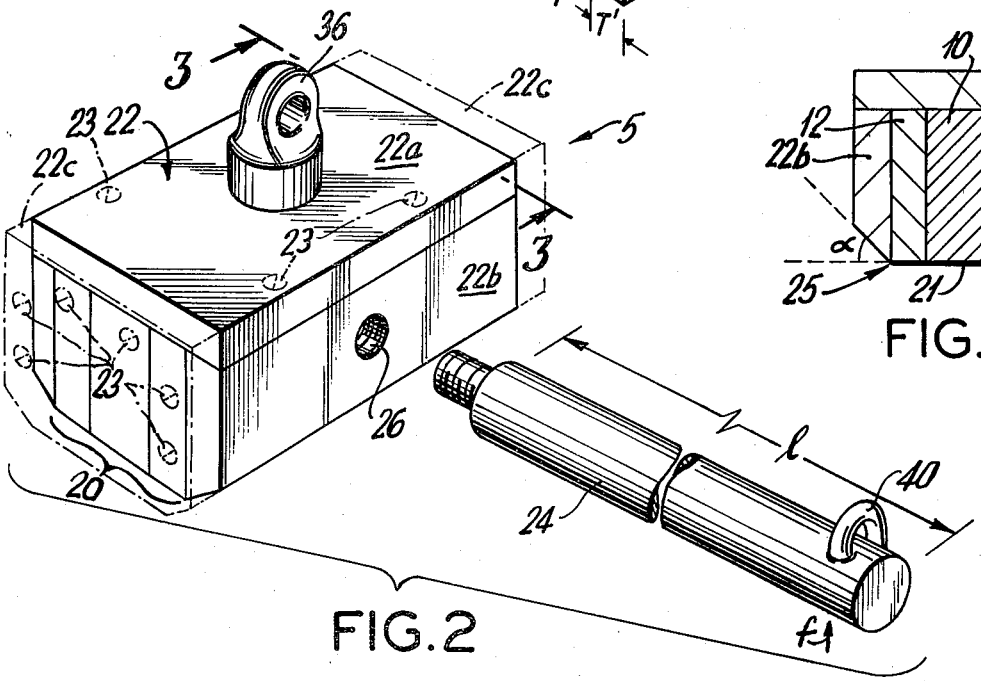
FIG. 2 is a perspective view of an embodiment of a permanent magnetic anchoring assembly according to the present invention.
Figure 3:
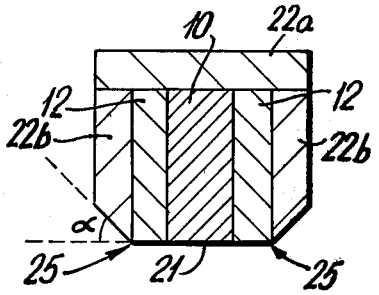
FIG. 3 is a sectional view taken along 3—3 of FIG. 2.
Figure 4:
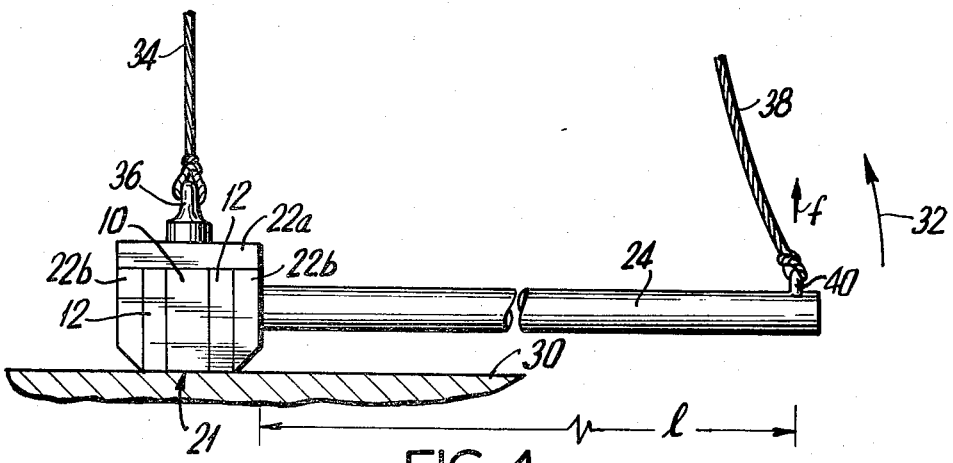
FIG. 4 is an end elevation of the structure illustrated in FIG. 2.

Turning now to FIGS. 2–4, there is shown a permanent magnet anchoring assembly (indicated generally at 5) according to another aspect of the present invention. As here embodied, anchoring assembly 5 includes a casing 22 adapted to encase a magnet element (indicated at 20) and to expose at least one surface (designated 21) of the magnet element, which surface is adapted to provide magnetically attractive coupling. As preferably embodied and illustrated herein, magnet element 20 comprises the composite magnet assembly (1) described above with reference to FIG. 1 because of its powerful magnetic attraction. However, it will be understood that the magnetic anchoring apparatus according to the invention can be used with any permanent magnet element.

Casing 22 includes top member 22*a* covering the opposite surface of magnet member 20 from magnetic engaging surface 21 and two side walls (both designated 22*b*) depending therefrom and covering the pole members (12) of magnet member 20, with the bottom edge of each side wall terminating essentially co-planar with the exposed surface (21) of magnet member 20. The casing may also include two end walls (both being indicated in phantom at 22*c* in FIG. 2), depending from top member 22*a*, with their bottom edges similarly terminating co-planar with exposed surface 21 to cover both end portions of magnet member 20. Casing 22 is made from a non-magnetically attractive material, such as aluminum, and may be integrally formed in a unitary structure or, for ease of assembly, the top member, side walls and end walls may be formed separately and held together by, for example, threaded fasteners (indicated in phantom at 23 in FIG. 2).

According to the invention, the bottom edge of at least one of the side wall portions 22*b* (as well as, of course, the corresponding bottom edge portions of end walls 22*c*) are beveled back from the exposed surface (21) of magnet element 20. In addition, leverage means are formed on the anchoring assembly in order to permit application of a moment about the beveled edge of casing 22. To this end, arm member 24 is affixed to casing 22, here by threadable engagement between an externally threaded end of arm 24 and a reciprocally threaded borehole (indicated at 26) formed in the side wall opposite the side wall with the beveled edge.

In operation, the magnetic anchoring assembly 5 is magnetically coupled to the desired magnetically attractive member (indicated at 30 in FIG. 4). The magnetic coupling between anchoring assembly 5 and anchoring surface 30 may be interrupted simply by pulling upwardly on arm member 24, as indicated by arrow 32. It will be found that the magnetic force between magnet member 20 and structure 30 is substantially more easily overcome by anchoring assembly 5 in comparison with the force required to "pull" magnet member 20 directly away from anchoring structure 30. Moreover, since the assembly bears against a bearing edge (designated 25) defined at the juncture between a pole member and the vertex of the beveled edge, there will be no danger of damaging the actual magnet(s) in the assembly and, since the composite magnet (1) will be encased within casing 22, there will be no danger of separating a pole member from a magnet (due to the large magnetic forces involved) during the rotational decoupling.

It will also be found that anchoring assembly 5 has substantial potential for making temporary but tenacious attachment of any desired object or device to any structure made of magnetically attractive material. For example, anchoring assembly 5 may be used to attach (by, e.g., cable/connector 34/36 affixed to casing 22) some maintenance-oriented device temporarily to the sloped side of a ship, even at a point below the water surface or for anchoring aircraft to the deck of an aircraft carrier to prevent it from falling off the ship in stormy seas, by dropping assembly 5 to the ship's deck and securing the other end of cable 34 to the aircraft.

To the same end, and in a particularly useful embodiment, two or more anchoring assemblies 5 may be attached to the "skids" of a helicopter to help anchor it to the deck of any ship. Casing 22 may be affixed to the helicopter skids, either by cable/eyelet assembly 34/36 or by a direct hinge-like connector (not shown). Once the helicopter has landed, the anchoring assemblies will secure it to the ship's deck and prevent its being rocked off. When the helicopter is to take-off, the pilot can simply pull on the cables 38 (each attached to an eyelet 40 formed on the free end of arm member 24), causing each assembly 5 to rotate about the beveled bearing edges (25) formed on casing 20, so as to disengage the magnetic coupling with the ship's deck. It will be understood that the same decoupling procedure could be used by the pilot of an aircraft which is anchored by assembly 5 via cable 34.

It will also be understood that the length (l in FIGS. 3 and 4) of arm 34, which enables only a relatively small force (f in FIGS. 3 and 4) to be required for "breaking" the magnetic coupling between magnetic engaging surface 21 and structure 30, can be calculated from standard engineering formulae relating to the principles of leverage. The following formula can be used to approximate the length, l, of lever arm 24:

$f(l+T+2T'+d) \cong F(T'+T/2)$, where d is the thickness of one casing side wall (22*b*), F is the resultant force of attraction provided by the magnet member (20), f is the approximate force desired to be exerted for breaking the magnetic coupling and T and T' are as explained above with reference to FIG. 1 [$(T'+T/2)$ is the approximate moment arm about which the magnetic attraction acts, relative to the bearing edge indicated in FIG. 4].

As preferably embodied, the bottom edge surfaces of both side walls are beveled to provide two bearing edges 25 and thereby permit disengagement under various circumstances. Also as preferably embodied, the beveled edge of casing 22 is set at an angle (indicated at $\alpha$ in FIG. 3) at least equal to about 10° which is sufficient to permit the bearing edge 25 to act as a fulcrum.

It will be understood by those skilled in the art that the aspects of the present invention are not limited to the specific embodiments disclosed herein. For example, if the magnet member (20) within casing 22 were simply a permanent magnet without pole members, part of the width of the bottom edge of each side wall 22*b* could extend co-planar with exposed magnetic surface 21 while the remaining width portion is beveled back as described above so that a protective lip is provided around the magnet by the co-planar width portion yet the beveled fulcrum edge is provided to facilitate decoupling when desired. In addition, in the composite magnet assembly according to the invention, electromagnets could be used by orienting them so that, when activated, similar poles will be aligned and will abut the same pole member.

Accordingly, variations may be made from the embodiments described herein, which are within the scope of the accompanying claims without departing from the principles of the invention or without sacrificing its chief advantage.

What is claimed is:

1. A composite magnet assembly which comprises:

at least two magnet members oriented to have their polar axes generally parallel and in the same polar orientation;

a pair of pole members made of a magnetically attractive material, each said pole member adapted to abut all the magnetic poles of similar polarity of said magnet members, such that each said pole member becomes a unipolar composite magnetic pole;

a casing member encasing said magnet members and said pole members to expose an edge of each pole member, said exposed edges defining a generally planar magnetic engaging surface and said casing providing a bearing edge adjacent and parallel to said engaging surface, said casing being proportioned with its edge portion adjacent said bearing edge being beveled; and leverage means attached to said casing, said leverage means adapted to enable said casing to be rotated about said bearing edge, such that magnetic engagement between said engaging surface and any magnetically attractive structure can be relatively easily interrupted by rotating said anchoring assembly, by said leverage means, about the bearing edge, the beveled casing edge facilitating rotation about said bearing edge.

2. A composite magnet assembly according to claim 1, wherein said magnet members are permanent magnets.

3. A composite magnet assembly according to claim 2, wherein said magnet members are bar magnets.

4. A composite magnet assembly according to claim 3, wherein said magnet members are samarium cobalt magnets.

5. A composite magnet assembly according to claim 1, wherein said magnet members are electromagnets oriented such that when said electromagnets are activated, resultant magnetic poles having the same polarity will abut the same pole member.

6. A composite magnet assembly according to claim 1 wherein said leverage means comprise an arm member extending outwardly from said casing generally perpendicular to said beveled bearing edge, such that the magnetic engagement can be interrupted by applying a force to said arm member for rotating the anchoring assembly about a said beveled edge of said casing.

7. A magnetic anchoring assembly for permanent magnets, comprising:

a permanent magnet member having a generally planar surface adapted to provide relatively strong magnetic attraction, said magnet member providing a North and a South pole along a planar surface portion thereof;

a casing generally within which said magnet member is retained, said casing exposing said planar surface of said magnet member and having at least one edge adjacent said exposed planar magnet surface to provide a bearing edge, said casing being beveled along each said bearing edge in a direction away from said exposed magnet surface; and leverage means associated with said casing, said leverage means enabling rotation of said magnet member about said bearing edge, such that magnetic coupling between said magnet member and a magnetically attractive structure can be interrupted relatively easily by applying a force on said leverage means to rotate said magnet member about said bearing edge, said beveled casing edge facilitating rotation of said anchoring assembly about said bearing edge.

8. A magnetic anchoring assembly according to claim 7, wherein said magnet member includes at least two permanent magnets, each having their magnetic poles abutting a pair of pole members made of magnetically attractive material.

9. A magnetic anchoring assembly according to claim 7, wherein said leverage means includes an arm member extending outwardly from said casing, generally perpendicular to the beveled edge of said casing to facilitate rotation of the magnet member about said beveled edge.

10. A magnetic anchoring assembly for permanent magnets, comprising:

a permanent magnet member having a generally planar surface adapted to provide relatively strong magnetic attraction, said magnet member providing a North and a South pole along a planar surface portion thereof;

a casing providing a cavity within which said magnet member is retained with its said planar surface exposed, said casing including a top member and two side walls depending therefrom to define said cavity, the bottom edges of said side walls being co-terminous with said planar surface, at least one of said side wall bottom edges being beveled towards said top member in a direction away from said exposed planar surface to provide a bearing edge; and leverage means associated with said casing, said leverage means enabling rotation of said magnet member about said bearing edge; such that magnetic coupling between said magnet member and a magnetically attractive structure can be interrupted relatively easily by applying a force on said leverage means to rotate said magnet member about said bearing edge, said beveled casing edge facilitating rotation of said anchoring assembly about said bearing edge.

11. A magnetic anchoring assembly according to claim 7 or 10 wherein said magnet member includes at least two permanent magnets, each having their magnetic poles abutting a pair of pole members made of a magnetically attractive material and wherein said bearing edge means is formed by at least one of said pole members, an edge of which provides said bearing edge.

* * * * *